US005224703A

United States Patent [19]

Osher

[11] Patent Number: 5,224,703

[45] Date of Patent: Jul. 6, 1993

[54] BALL PROPELLING AND CATCHING RACQUET

[75] Inventor: John D. Osher, Pepper Pike, Ohio

[73] Assignee: Cap Toys, Inc., Bedford Heights, Ohio

[21] Appl. No.: 974,788

[22] Filed: Nov. 12, 1992

[51] Int. Cl.[5] ..... A63B 59/00; F41B 7/00

[52] U.S. Cl. ..... 273/67 R; 273/326; 124/20.1

[58] Field of Search ..... 124/20.15; 273/67, 323–328, 273/266, 72 A, 72 R, 73 C

[56] References Cited

U.S. PATENT DOCUMENTS

| | | | |
|---|---|---|---|
| 534,996 | 3/1995 | Cundy . | |
| 1,008,073 | 11/1911 | Sato . | |
| 1,866,158 | 11/1930 | Goodwin . | |
| 1,972,803 | 9/1934 | Taylor | 273/323 |
| 2,369,145 | 9/1942 | Kent . | |
| 3,724,058 | 4/1973 | Dahl | 273/326 |
| 3,871,653 | 3/1975 | Sambos . | |
| 3,992,008 | 11/1976 | Watkin . | |
| 4,250,861 | 2/1981 | Ellenburg | 124/20.1 |

FOREIGN PATENT DOCUMENTS

| | | | |
|---|---|---|---|
| 2125207 | 11/1972 | Fed. Rep. of Germany | 273/328 |
| 391531 | 6/1908 | France | 273/326 |
| 630000 | 11/1927 | France | 273/326 |
| 1015748 | 10/1952 | France | 273/326 |

*Primary Examiner*—Mark S. Graham

[57] ABSTRACT

A game racquet for propelling and catching a ball. The racquet includes a frame and a handle extending from the frame. A first net is attached to the frame so that it can be stretched relative to the frame to propel a ball when the stretched net is released. A ball receiving pocket is formed as part of the first net. A second net is attached to the frame in a nonstretchable relative inside the first net. The second net is formed of a smaller mesh to prevent a caught ball from passing through or bouncing out of the first net. An elongated arm engaging support is pivotally mounted on the frame for rotation between an arm engaging position in which the support extends away from the racquet and a storage position in which the support is folded against the racquet.

3 Claims, 2 Drawing Sheets

BALL PROPELLING AND CATCHING RACQUET

BACKGROUND AND SUMMARY OF THE INVENTION

This invention is directed to a game racquet which can be used to propel and to catch a ball, generally a ball which is propelled from a similar racquet. In playing the game, one player propels a ball from his racquet and the other player attempts to catch the ball in the net of his racquet.

The novel racquet of this invention is equipped with a net having a pocket which holds the ball while the net is being stretched until the ball is propelled. The net is mounted to the frame of the racquet so that the net can be stretched and then released to propel the ball from the pocket. The ball which is used is preferably a soft foam type ball although other and harder types of balls may be used especially by players who have developed advanced skills in playing this game.

Preferably, the ball propelling net is formed of an elastic material such as stretchable cards so that the net can be stretched and released to propel the ball. Alternately, the net can be formed of an inelastic material which is elastically mounted to the frame so, in effect, that the net can be stretched and released to propel a ball.

Another feature of this invention is the provision of an inner net which is formed of a much finer mesh than the outer net and is non-elastic. The inner net performs the function of preventing a caught ball from passing through the cords of the outer net and also prevents the caught ball from bouncing out of the outer net.

In another aspect of this invention, a support which engages the forearm of a player is pivotally attached to the frame. The purpose of the support is to prevent the racquet frame from being pulled backwards as the net is stretched by the player to propel the ball.

In another unique aspect of the invention, the frame support is pivotally mounted to the racquet so that it can be folded up against the frame of the racquet for compact storage and shipment.

Other objects and advantages of the invention may be found in the following specification, claims, and drawings.

BRIEF DESCRIPTION OF THE DRAWINGS

The invention is illustrated more or less diagrammatically in the following drawings wherein.

DESCRIPTION OF THE PREFERRED EMBODIMENT

Figure 1:
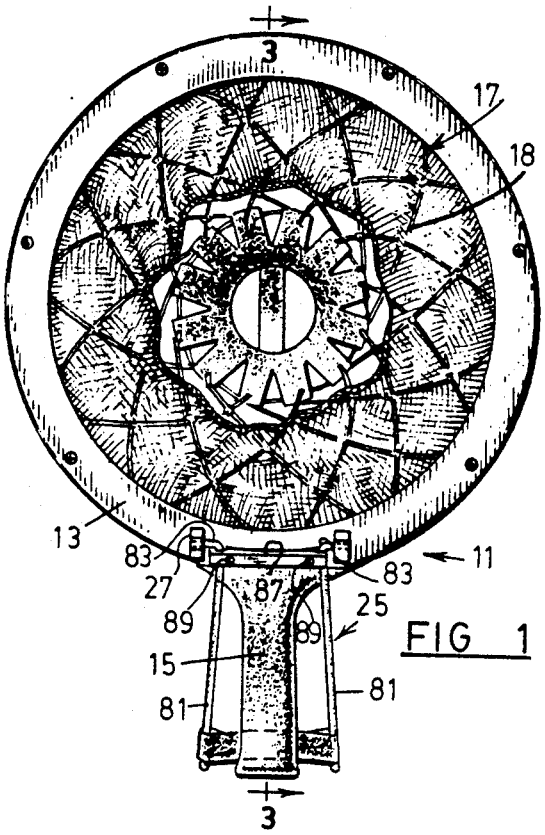
FIG. 1 is a front elevational view of the racquet of this invention with the outer ball propelling net stretched and with the arm engaging support in a lowered position.
Figure 2:
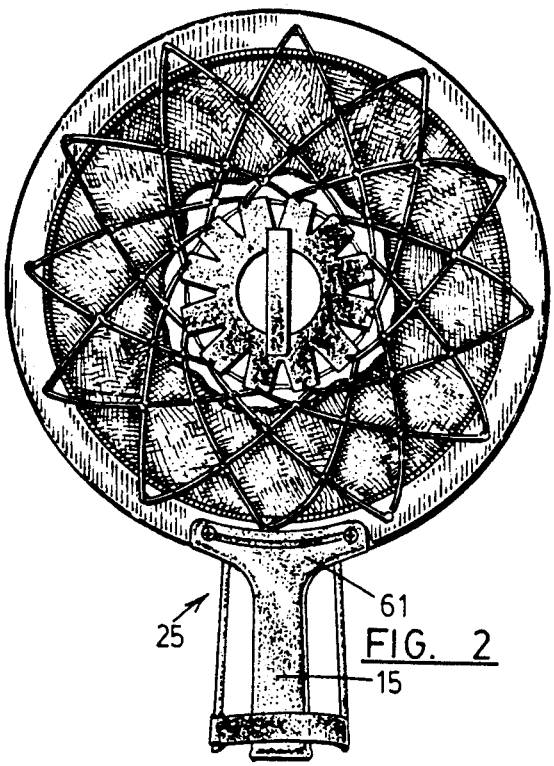
FIG. 2 is a rear elevational view of the racquet in the condition of FIG. 1.

The drawings show a racquet 11 intended to be used with the game of this invention. The racquet 11 has a frame 13 which is annular in shape and is fastened to a handle 15. An outer net 17 formed of knotted elastic cords 18 is attached to the frame as is an inner net 19 formed of an inelastic material having a smaller mesh. A pocket 21 is formed with fingers 22 which are affixed to the cords 18 at the bottom or end of the outer net. A pull 23 is formed as part of the pocket. An arm engaging support 25 is pivotally attached to the frame 13 by its attachment to posts 27 formed integrally with the frame.

Figure 3:
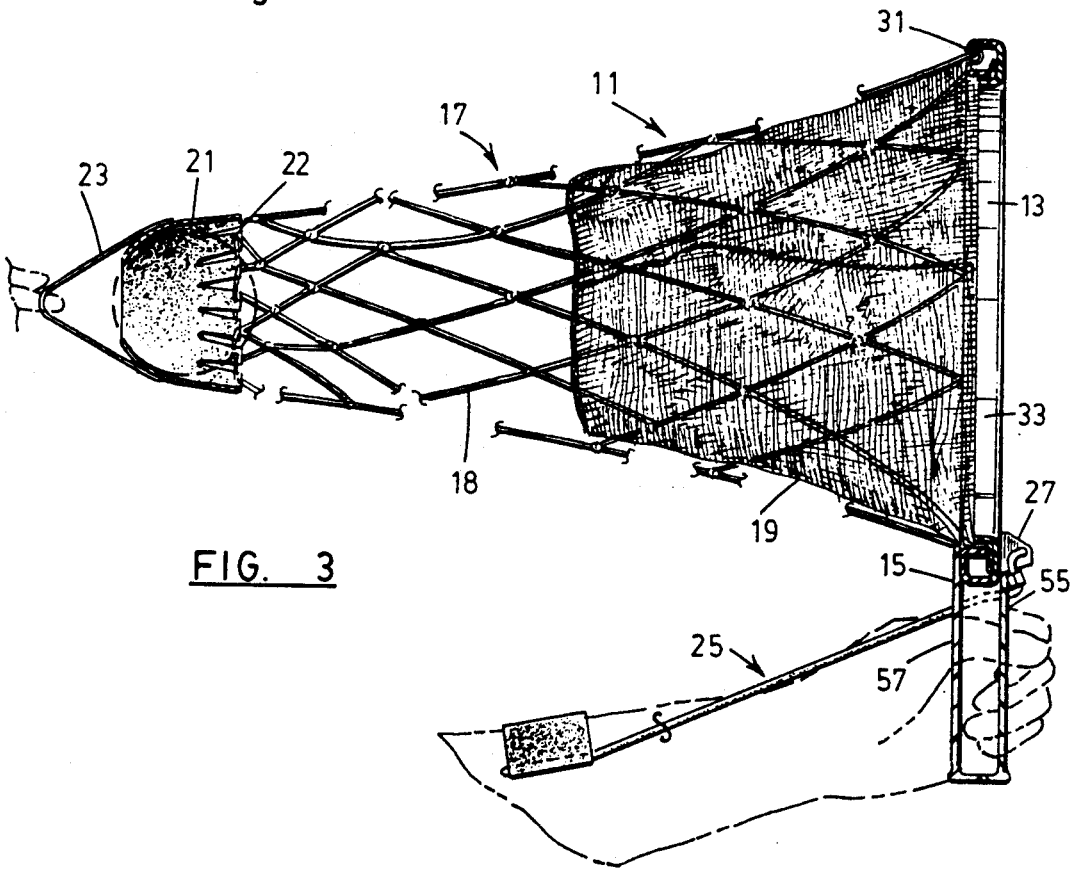
FIG. 3 is a view taken along line 3—3 of FIG. 1 showing the racquet of this invention with a ball seated in the pocket, the propelling net stretched, and the arm engaging support in its engaged position against the forearm of a player.
Figure 4:
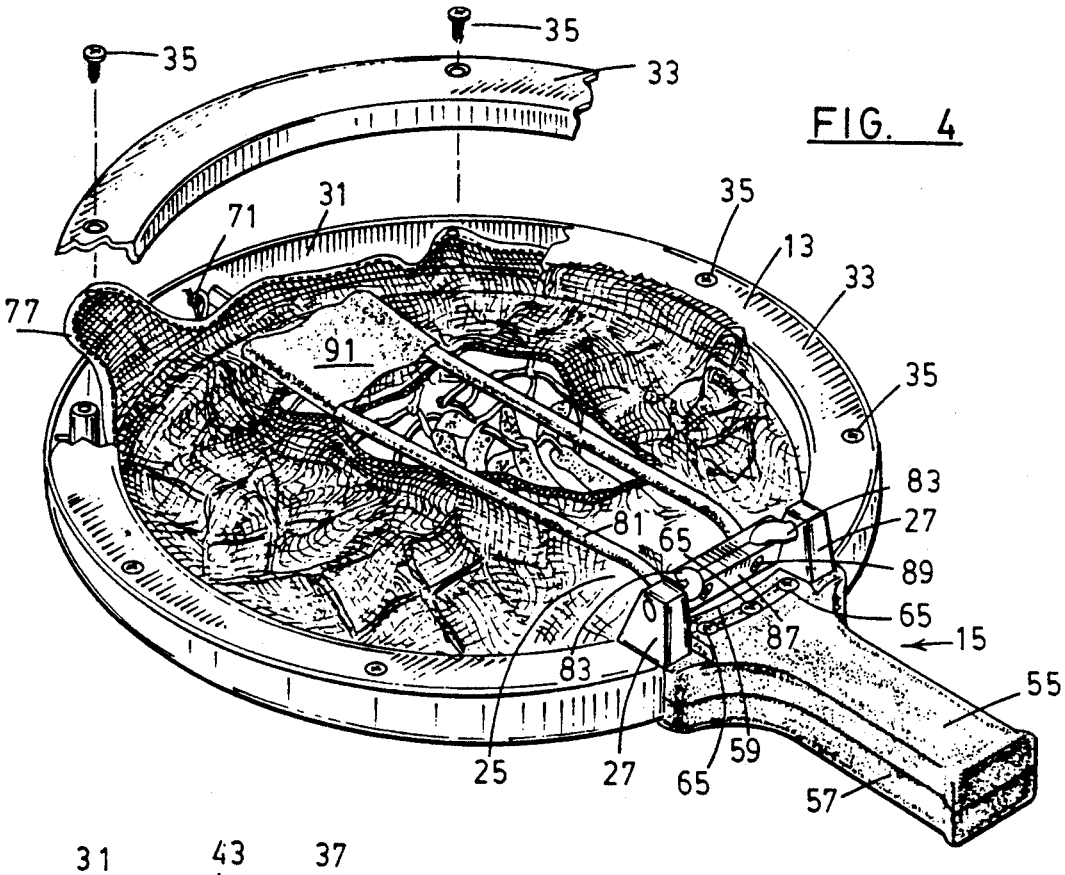
FIG. 4 is a perspective view of the racquet with a broken away portion shown in an exploded position and with the arm engaging support shown in its folded storage position.
Figure 5:
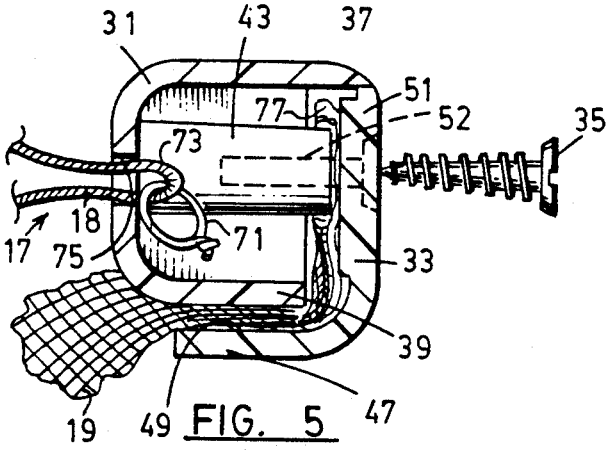
FIG. 5 is an enlarged, partial, cross sectional view showing the attachment of the outer and inner nets to the frame.
Figure 6:
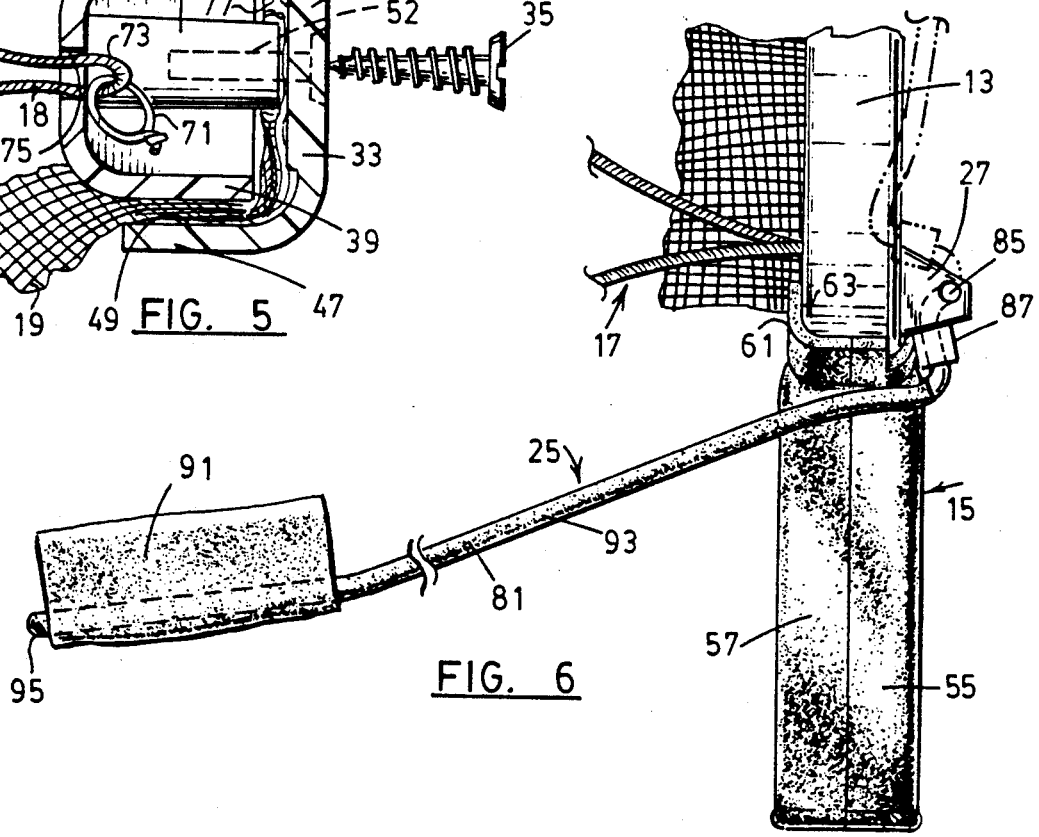
FIG. 6 is an enlarged, partial, side elevational view showing the engaged position of the frame support in solid lines and the storage position of the frame support in dashed lines.

The frame 13 is formed of a rear section 31 and a front section 33 which are shown most clearly in FIGS. 3, 4, and 5 of the drawings. The sections ar each molded from a suitable strong resilient plastic and held together by screws 35 to form a hollow frame 13. The rear section 31 of the frame is U-shaped in radial cross section having an outer circumferential wall 37 and a shorter inner circumferential wall 39. A base wall 41 connects the inner and outer circumferential walls. Upstanding hollow posts 41 extend from the base wall 41 terminating short of the outer circumferential wall 37.

The front section 33 of the hollow frame 13 is also molded of plastic and has an inner circumferential wall 47 which telescopes over the inner circumferential wall 39 of the rear section 31 of the frame 13 to form a passage 49 leading into the hollow interior of the frame. A front wall 51 is formed integrally with the inner circumferential wall 47 to form the front facing portion of the frame 13. This wall has openings 52 formed therein to receive the screws 35 which extend through the openings and into the hollow posts 43 to hold the rear and front sections 31 and 33 of the frame together.

The handle 15 is formed with a front portion 55 and a rear portion 57 which are fastened together by an adhesive, electronic welding, or in any other suitable manner. The front portion 55 of the handle 15 has a flared arcuate extension 59 and the rear portion of the handle 15 has a flared arcuate extension 61 which together form a channel 63 which receives the frame 13. Screws 65 extend through the extensions and the frame to fasten the handle to the frame.

The outer net 17 consisting of the elastic cords 18 is held to the frame 13 of the racquet 11 by means of wire loops 71. As can be best seen in FIGS. 4 and 5 of the drawings, bight portions 73 of the elastic cords 18 are inserted into the hollow frame 13 through passages 75. Each wire loop is passed through a bight 73 to prevent the cords from pulling out through the passages 75. The inner net 19 is held to the front wall 51 of the front section 33 of the frame 13 by the screws 35 which pass through a edge binding 77 formed on the inner net 19 as can best be seen in FIGS. 4 and 5 of the drawings.

The arm engaging support 25 includes a pair of metal rods 81. Each rod is bent to form at one end a laterally extending axle 83 which fits into a hole 85 formed in one of the posts 27. The rods 81 are spread apart for journalling in the holes 85 by a pair of spread bars 87 which clamp over the rods 81 and are held together by screws 89. The spread bars 87 maintain the spacing of the metal rods 81 and hold their axle ends 83 in the holes 85 in the posts 27. The opposite ends of the rods 81 forming the arm engaging support 25 are held together by a piece of reinforced plastic tape 91 which is bowed and also functions as a rest to engage the user's forearm as shown in FIG. 3 of the drawings. The ends of the piece of tape are folded over the metal rods and self-adhered to the tape to form loops around the rods. The metal rods 81 may be covered with plastic tubes 93 and plastic plugs 95 may be inserted into the ends of the tubes 93 for appearance sake.

I claim:

1. A game racquet for propelling and catching a ball, including:

a frame, a handle extending from said frame, a first net attached to said frame and adapted to be stretched relative to said frame to propel a ball when said stretched net is released, a ball receiving pocket formed as part of said first net, a second net attached to said frame in a non-stretchable relation and positioned inside said first net, said second net having a smaller mesh than said first net to prevent a ball from passing through or bouncing out of said first net when said ball is caught in said first net.

2. The game racquet of claim 1 in which said first net is formed of elastic cords.

3. The game racquet of claim 2 in which said ball receiving pocket is formed with a plurality of fingers, each of which fingers attaches to an elastic cord of said first net.

* * * * *